US006173963B1

(12) United States Patent
Ho et al.

(10) Patent No.: US 6,173,963 B1
(45) Date of Patent: Jan. 16, 2001

(54) SEALING ASSEMBLY FOR AN INLET VALVE OF A POWER NAILER

(75) Inventors: Roman Ho; Sunking Hung; Jack Chen, all of Taichung (TW)

(73) Assignee: Basso Industry Corp., Taichung (TW)

( * ) Notice: Under 35 U.S.C. 154(b), the term of this patent shall be extended for 0 days.

(21) Appl. No.: 09/309,538

(22) Filed: May 11, 1999

(51) Int. Cl.[7] ..... B25C 1/04

(52) U.S. Cl. ..... 277/361; 227/130; 277/394; 277/572

(58) Field of Search ..... 277/361, 390, 277/394, 437, 549, 551, 572; 227/130, 8; 137/384

(56) References Cited

U.S. PATENT DOCUMENTS 5,131,579 * 7/1992 Okushima et al. ..... 227/8
5,671,880 * 9/1997 Ronconi ..... 227/130
5,829,660 * 11/1998 White ..... 227/8
5,860,447 * 1/1999 Chu ..... 137/505.25
5,927,584 * 7/1999 Akiba ..... 227/130

* cited by examiner

*Primary Examiner*—Anthony Knight
*Assistant Examiner*—Alison K. Pickard
(74) *Attorney, Agent, or Firm*—Charles E. Baxley

(57) ABSTRACT

A sealing assembly for an inlet valve of a power nailer includes a fixed frame and a movable member which has a tubular portion movably inserted through the central hole of the fixed frame and is biased by a spring. The movable member is connected to the cylinder so as to push the piston of the cylinder. The fixed frame has a flange with a tapered distal edge so that a seal is mounted to the flange and the seal has a tongue portion rested on the tapered distal edge. The tongue portion movably contacts the tubular portion. The movable member has a tapered distal edge on which a tongue portion of another seal is rested and movably contacts a flange of the fixed frame.

7 Claims, 5 Drawing Sheets

SEALING ASSEMBLY FOR AN INLET VALVE OF A POWER NAILER

FIELD OF THE INVENTION

The present invention relates to a sealing assembly for a valve in a power nailer, wherein the movable member of the valve has two seals mounted thereto and each seal has an inclined and flexible portion so as to seal the portion between the movable member and the fixed frame when the movable member is moving.

BACKGROUND OF THE INVENTION

A conventional sealing assembly for an inlet valve of a power nailer is shown in FIG. 1, wherein the inlet valve generally includes a fixed frame 200 which fixedly attached to the end opposite to the nail ejecting end of the barrel, and a movable member 300 which is movably engaged with the fixed frame 200 and biased by a spring 330. The fixed frame 200 is a ring-shaped member and has a first annular flange 210 extending from the outside thereof and a second annular flange 220 extending from one of two sides of the fixed frame 200. The movable member 300 has a shape similar to that of the fixed frame 200 and includes a third annular 320 flange extending from the outside thereof so as to movably engage with the inside of the first annular flange 210, and a fourth annular flange 310 which is inserted through the central hole of the ring-shaped fixed frame 200. The spring 330 is biased between the end cap 400 and one of two sides of the movable member 300. A first seal 600 is received between the second annular flange 220 and the fourth annular flange 310, and a second seal 500 is engaged with the distal edge of the first annular flange 210 and the other side of the movable member 300. The first seal 600 has two contact points 610, 630 movably contact the fourth annular flange 310 of the movable member 300, and the other two contact points 620, 640 contact the second annular flange 220 of the fixed frame 200. The second seal 500 has a deformable portion 530 which allows the second seal 500 to be deformed without disengaging from the fixed frame 200 or the movable member 300 while the movable member 300 is moved reciprocatingly.

A piston 700 with a driving shaft 710 is movably received in the cylinder 720. The cylinder 720 has one end thereof that the nails (not shown) are ejected by the driving shaft 710, and the other end thereof which is connected to the movable member 300. When the trigger (not shown) is pulled, the high pressure air enters into the space between the movable member 300 and the piston 700 so as to push the piston 700 to eject the nail and, in the same time, the movable member 300 is moved to compress the spring 330. When the trigger is released, the movable member 300 is biased by the spring 330 to be moved toward the cylinder 720.

When the high pressure air enters into the barrel, the first seal 600 is expanded and the inner periphery including the two contact points 610, 630 is attached to the fourth annular flange 310 so that the frictional force between the first seal 600 and the fourth annular flange 310 of the movable member 300 is large.

Furthermore, when the movable member 300 is moving, the second seal 500 is stretched between the distal edge of the first annular flange 210 and the movable member 300. The second seal 500 could be broken after being used for a period of time.

The present invention intends to provide a seal assembly which includes two seals respectively connected between the movable member and the fixed frame, and provides less frictional force between the movable member and the fixed frame.

The present invention has arisen to mitigate and/or obviate the disadvantages of the conventional sealing assembly of a power nailer.

SUMMARY OF THE INVENTION

In accordance with one aspect of the present invention, there is provided a combination of a sealing assembly and an inlet valve of a power nailer, comprising a fixed frame having a central hole and a first flange extending from the outside of the fixed frame. A second flange extends from one of two sides of the fixed frame and a third flange extends from the periphery defining the central hole through which the tubular portion of a movable member extends, The third flange has a first tapered distal edge.

The movable member is movably engaged with the first flange at an outer periphery thereof and biased by a spring. The movable member has a second tapered distal edge defined in one of two sides thereof and the second tapered distal edge is located near the outer periphery of the movable member.

A first seal is received between the second flange and the third flange of the fixed frame. The first seal has a first tongue portion extending radially inward therefrom and rested on the first tapered distal edge of the movable member so that the first tongue portion movably contacts the tubular portion of the movable member. A second seal is engaged with the movable member and has a second tongue portion extending radially outward therefrom. The second tongue portion is rested on the second tapered distal edge and movably contacts the first flange.

The primary object of the present invention is to provide a sealing assembly which provides less frictional force between the fixed frame and the movable member.

Further objects, advantages, and features of the present invention will become apparent from the following detailed description with appropriate reference to the accompanying drawings.

DETAILED DESCRIPTION OF THE PREFERRED EMBODIMENTS

Figure 1:
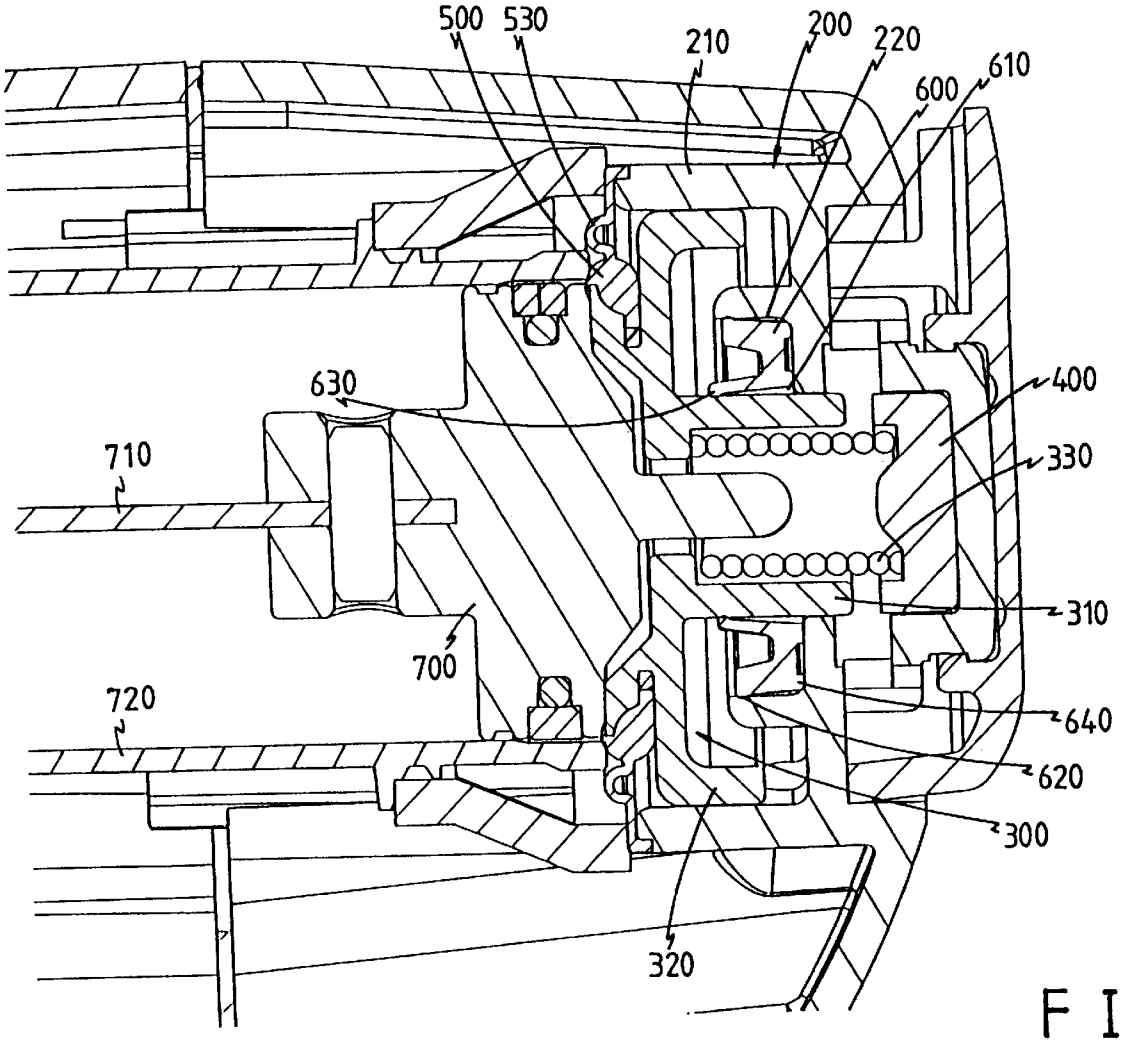
FIG. 1 PRIOR ART
FIG. 1 is a side elevational view, partly in section, of the rear end of a power nailer and shows the arrangement of the conventional seals.
Figure 2:
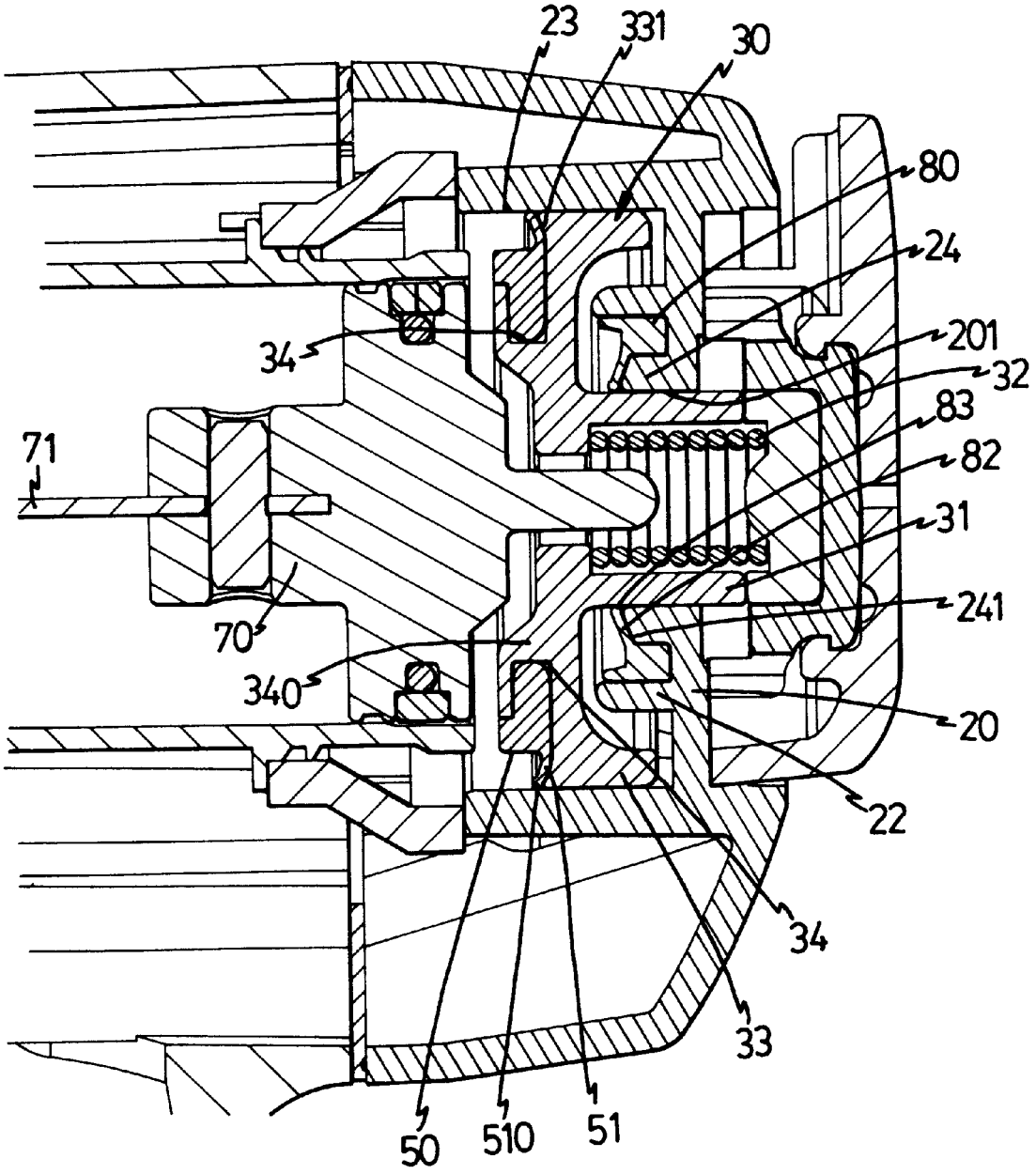
FIG. 2 is a side elevational view, partly in section, of the rear end of a power nailer and shows the arrangement of the sealing assembly in accordance with the present invention.
Figure 3:
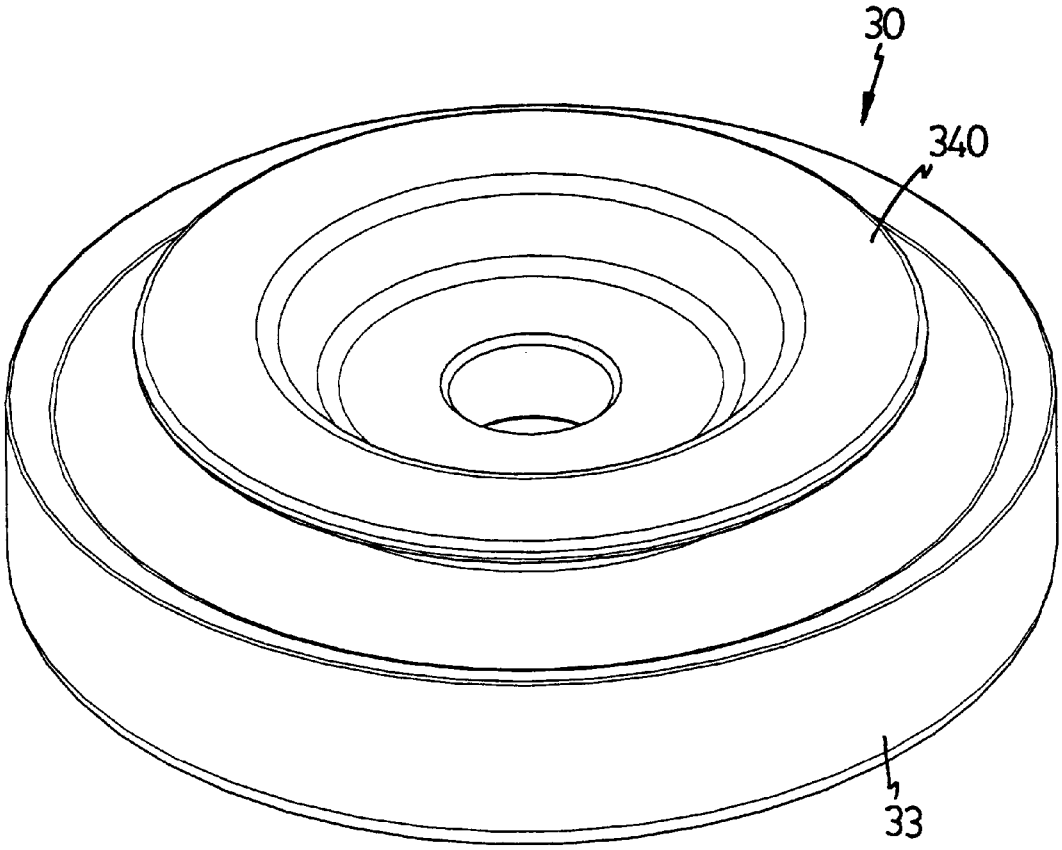
FIG. 3 is a perspective view of the movable member in accordance with the present invention.
Figure 4:
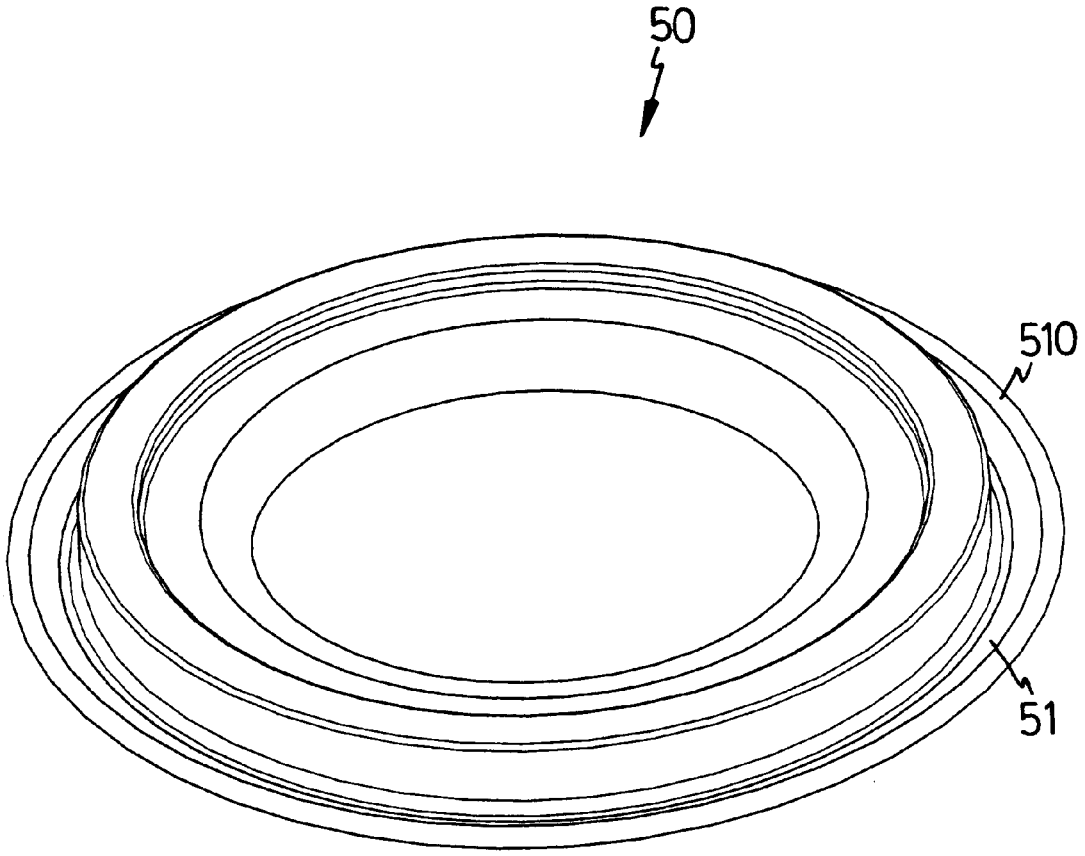
FIG. 4 is a perspective view of the second seal mounted to the movable member in accordance with the present invention.

Referring to FIGS. 2 to 4, a structure of the rear end of a power nailer is shown in FIG. 1 and an inlet valve comprising a fixed frame 20 and a movable member 30 is disposed in the rear end of the barrel of the power nailer. The movable member 30 is moved by pulling the trigger (not shown) of the power nailer so as to let the high pressure air enter the desired chamber in the rear end of the power nailer to push the piston 70 and the driving shaft 71 connected to the piston 70 so that a nail (not shown) can be ejected form the front end of the power nailer.

The fixed frame 20 has a central hole 201, and a first flange 23 and a second flange 22 respective extend from the first side of the fixed frame 20. A third flange 24 extends from the periphery defining the central hole 201 of the first side of the fixed frame 20 and toward the same direction of the first flange 23 and the second flange 22. The third flange 24 has a first tapered distal edge 241.

Referring to FIG. 3, the movable member 30 has a fourth flange 33 extending from the first side thereof and the fourth flange 33 movably contacts the inside of the first flange 23 of the fixed frame 20. A tubular portion 31 extends from the first side of the movable member 30 and extends through the central hole 201 of the fixed frame 20. The movable member is biased by a spring 32 by the same manner as that disclosed in FIG. 1. The movable member 30 has a second tapered distal edge 331 defined in the second side thereof and the second tapered distal edge 331 is located on the opposite end of the fourth flange 33. An L-shaped lip 340 extends from the second side of the movable member 30 so as to define a groove 34 between the lip 340 and the second side of the movable member 30.

A first seal 80 is received between the second flange 22 and the third flange 24 of the fixed frame 20. The first seal 80 has a first tongue portion 82 extending radially inward therefrom and rested on the first tapered distal edge 241 of the movable member 20. The first tongue portion 82 has a spherical distal edge 83 so that the spherical edge 83 of the first tongue portion 82 movably contacts the tubular portion 31 of the movable member 30.

Referring to FIG. 4, a second seal 50 is engaged with the groove 34 of the movable member 30 and has a second tongue portion 51 extending radially outward therefrom. The second tongue portion 51 has a spherical distal edge 510 and the second tongue portion 51 rested on the second tapered distal edge 331 so that the spherical distal edge 510 movably contacts the first flange 23.

Accordingly, the contact area between the first seal 80 and the tubular portion 31 of the movable member 30, and between the second seal 50 and the inside of the first flange 23 are very limited so that the frictional force therebetween while the movable member 30 is moving is therefore effectively reduced. During the period that the movable member 30 is moving, the second seal 50 is moved with the movable member 30 so that the second seal 50 can be used for a long time.

Figure 5:
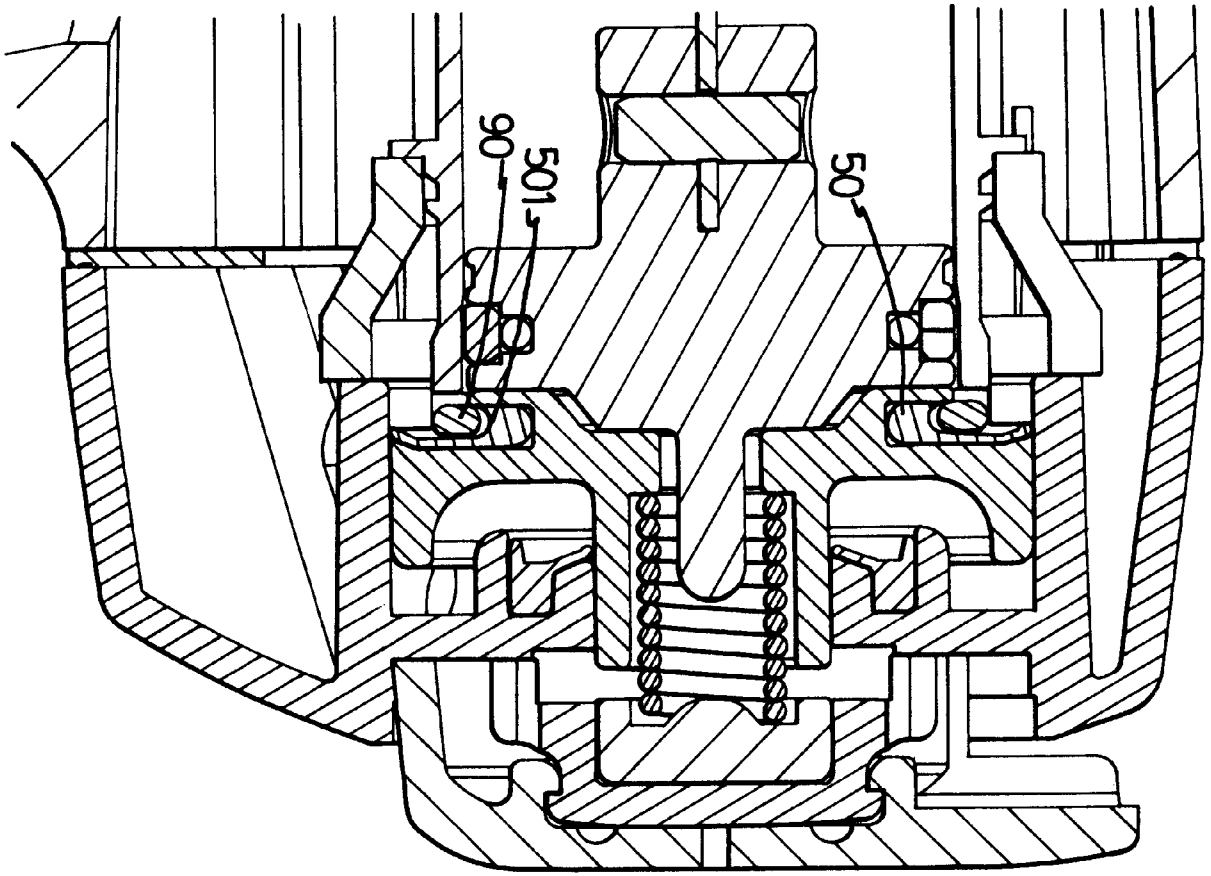
FIG. 5 is a side elevational view, partly in section, of the rear end of a power nailer and shows another embodiment of the arrangement of the sealing assembly in accordance with the present invention.

Referring to FIG. 5, in order to more secure the second ring 50', the second seal 50' has a groove 501 and an O-ring 90 is securely received in the groove 501 of the second seal 50'.

The invention is not limited to the above embodiment but various modification thereof may be made. It will be understood by those skilled in the art that various changes in form and detail may made without departing from the scope and spirit of the present invention.

What is claimed is:

1. A combination of a sealing assembly and an inlet valve of a power nailer, comprising:

a fixed frame having a central hole, a first flange and a second flange respectively extending from one of two sides of said fixed frame, a third flange extending from the periphery defining said central hole and toward the same direction of said first flange, said third flange having a first tapered distal edge;

a movable member movably engaged with said first flange of said fixed frame at an outer periphery thereof and said movable member being biased by a spring, a tubular portion extending from a first side of said movable member and engaged with said central hole of said fixed frame, said movable member having a second tapered distal edge defined in a second side thereof and said second tapered distal edge located near said outer periphery of said movable member;

a first seal received between said second flange and said third flange of said fixed frame, said first seal having a first tongue portion extending radially inward therefrom and rested on said first tapered distal edge of said third flange, said first tongue portion movably contacting said tubular portion of said movable member, and a second seal engaged with said movable member and having a second tongue portion extending radially outward therefrom, said second tongue portion rested on said second tapered distal edge and movably contacting said first flange.

2. The combination as claimed in claim 1, wherein said movable member has a fourth flange extending from the first side thereof and said fourth flange movably contacts the inside of said first flange of said fixed frame.

3. The combination as claimed in claim 1, wherein said movable member has an L-shaped lip extending from the second side thereof so as to define a groove between the lip and said second side of said movable member so that said second seal is received in said groove.

4. The combination as claimed in claim 1, wherein said first tongue portion has a spherical distal edge.

5. The combination as claimed in claim 1, wherein said second tongue portion has a spherical distal edge.

6. The combination as claimed in claim 1 further comprising an O-ring securely mounted to the second seal.

7. The combination as claimed in claim 6 further comprising a groove defined in said second seal so that said O-ring is securely received in said groove of said second seal.

* * * * *